US008130170B2

(12) United States Patent
Nakahata et al.

(10) Patent No.: US 8,130,170 B2
(45) Date of Patent: Mar. 6, 2012

(54) ELECTRONIC APPARATUS

(75) Inventors: Masaomi Nakahata, Kanagawa-ken (JP); Tomoko Honda, Kanagawa-ken (JP); Yoshikazu Hata, Kanagawa-ken (JP); Satoru Honda, Kanagawa-ken (JP); Jun Morimoto, Kanagawa-ken (JP); Nobuyoshi Kuroiwa, Kanagawa-ken (JP); Akihiro Tsujimura, Tokyo (JP); Koichi Sato, Tokyo (JP); Minoru Sakurai, Tokyo (JP); Makoto Tabata, Tokyo (JP); Shoji Kato, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 689 days.

(21) Appl. No.: 11/902,449

(22) Filed: Sep. 21, 2007

(65) Prior Publication Data

US 2008/0150815 A1 Jun. 26, 2008

(30) Foreign Application Priority Data

Dec. 20, 2006 (JP) ..... 2006-343485

(51) Int. Cl.
*H01Q 1/24* (2006.01)

(52) U.S. Cl. ..... 343/906; 343/702; 343/872

(58) Field of Classification Search ..... 343/702, 343/906, 872, 873; 455/575.1, 575.3, 575.4, 455/575.7, 575.8, 90.3; 439/76.1; 361/737
See application file for complete search history.

(56) References Cited

U.S. PATENT DOCUMENTS

| | | | | |
|---|---|---|---|---|
| 5,066,235 | A * | 11/1991 | Kobayashi | 439/76.1 |
| 6,876,837 | B2 * | 4/2005 | Kuroshima et al. | 455/90.3 |
| 7,498,990 | B2 * | 3/2009 | Park et al. | 343/702 |
| 2006/0170597 | A1 * | 8/2006 | Kurashima et al. | 343/700 MS |

FOREIGN PATENT DOCUMENTS

| | | |
|---|---|---|
| CN | 1862877 (A) | 11/2006 |
| JP | 2001-024763 | 1/2001 |
| JP | 2003-234668 | 8/2003 |
| JP | 2003-273623 | 9/2003 |
| JP | 2004-533144 | 10/2004 |
| JP | 2005-006096 | 1/2005 |

OTHER PUBLICATIONS

Notification of Reasons for Refusal dated Feb. 21, 2011, issued in Counterpart Japanese Patent Application No. 2006-343485 (4 pages total).

Notification of First Office Action dated Dec. 9, 2010, issued in Counterpart Chinese Patent Application No. 200710159917.6 (11 pages total).

* cited by examiner

*Primary Examiner* — Jacob Y Choi
*Assistant Examiner* — Robert Karacsony
(74) *Attorney, Agent, or Firm* — Finnegan, Henderson, Farabow, Garrett & Dunner, L.L.P.

(57) ABSTRACT

An electronic apparatus includes: a first molded body; a second molded body which composes a housing with the first molded body; a first conductive pattern provided on an outer surface of the first molded body; a second conductive pattern provided in the housing; and a first conductive pin. The first conductive pin passes through the first molded body and connects the first conductive pattern and the second conductive pattern.

16 Claims, 7 Drawing Sheets

ELECTRONIC APPARATUS

CROSS-REFERENCE TO RELATED APPLICATIONS

This application is based upon and claims the benefit of priority from the prior Japanese Patent Application No. 2006-343485, filed on Dec. 20, 2006; the entire contents of which are incorporated herein by reference.

BACKGROUND OF THE INVENTION

1. Field of the Invention

This invention relates to an electronic apparatus.

2. Background Art

A folding-type or sliding-type electronic apparatus including cellular telephones and PDA (Personal Digital Assistance), the housing is composed of an upper housing and a lower housing. In this case, for example, the upper housing is a display portion and the lower housing is an operating portion including a keyboard part.

Each of the housings contains two molded bodies, and a liquid crystal display device, a key board part, a substrate on which electronic components are disposed, a secondary battery, and so forth are housed.

When an electric circuit such as an antenna pattern provided on an outer surface of a first molded body is connected inside the housing, a screw cramp of a power supply terminal or connection by a sheet metal is used. However, position of a screw cramp is occasionally restricted. Moreover, connection by a sheet metal has a problem of causing a surface step, and so forth. Furthermore, an area to which the power supply terminal or the sheet metal is attached is required, and they are disadvantageous for downsizing and thinning of an electronic apparatus.

There is a disclosed example of a technique in which an antenna composed of a metal frame, a conductive hinge part, and so forth is connected to a substrate inside a housing through a power supply terminal fixed with a screw (Japanese Unexamined Patent Publication JP-A 2005-6096 (Kokai)).

SUMMARY OF THE INVENTION

According to an aspect of the invention, there is provided an electronic apparatus including: a first molded body made of an insulator; a second molded body made of an insulator and closed together with the first molded body; a first conductive pattern provided on an outer surface of the first molded body; a second conductive pattern provided on a substrate, the substrate being fixed to the second molded body; and a first conductive pin provided so as to pass through the first molded body and connecting the first conductive pattern and the second conductive pattern.

According to another aspect of the invention, there is provided an electronic apparatus including: a first molded body; a second molded body, the second molded body composing a housing with the first molded body; a first conductive pattern provided on an outer surface of the first molded body; a second conductive pattern provided in the housing; and a first conductive pin passing through the first molded body and connecting the first conductive pattern and the second conductive pattern.

DETAILED DESCRIPTION OF THE INVENTION

Hereinafter, embodiments of this invention will be explained with reference to drawing.

Figure 1:
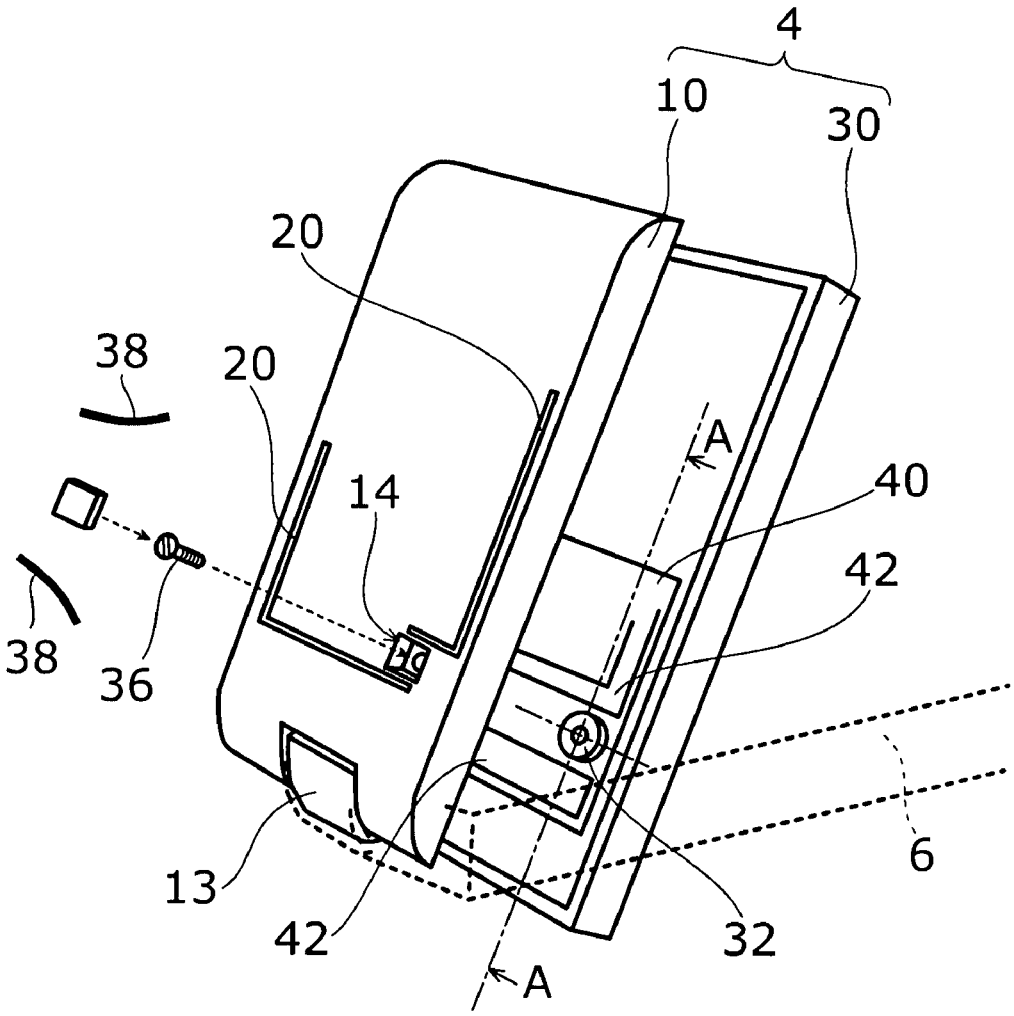
FIG. 1 is a schematic view showing a structure of an electronic apparatus according to an embodiment of this invention.

FIG. 1 is a schematic view showing a structure of an electronic apparatus according to an embodiment of this invention. An electronic apparatus such as a cellular telephone is a folding type in which an upper housing 4 and a lower housing 6 are contained and connected with a hinge part 13. The upper housing 4 contains first and second molded bodies 10, 30, and FIG. 1 shows a state before fixation. In the case of folding-type or sliding-type electronic apparatus, occasionally, one housing is a display portion including a flat panel display such as liquid crystal screen and the other housing is an operating portion including a key board, but the housings are not limited thereto.

In FIG. 1, two antenna patterns 20 are provided on an outer surface in the first molded body 10. A concave portion 14 is provided and a hole for passing a male screw 36 therethrough is provided in the bottom of the concave portion 14.

On the other hand, a substrate 40 on which electronic components are disposed in the second molded body 30, and a boss 32 is provided on the inner surface of the second molded body 30. In the substrate 40, for example, an opening for setting the boss 32 therein is formed.

The concave portion 14 of the first molded body 10 and the boss 32 of the second molded body 30 and so forth can be easily formed by mold-forming with a resin material, or the like.

An end of the antenna pattern 20 provided on an outer surface of the first molded body 10 is extended to the vicinity of the concave portion 14. A conductive pin 38 passing through the side wall of the concave portion 14 reaches a conductive pattern 42 provided on the substrate 40 and connects the end of the antenna pattern 20 in the vicinity of the concave portion 14 and the conductive pattern 42.

By this embodiment, the antenna pattern 20 on the outer surface is connected to a power supply part inside the housing or the like through the conductive pattern 42 of the substrate 40 and enables sending and receiving in the electronic apparatus.

Next, action of the conductive pin 38 will be explained.

Figure 2A:
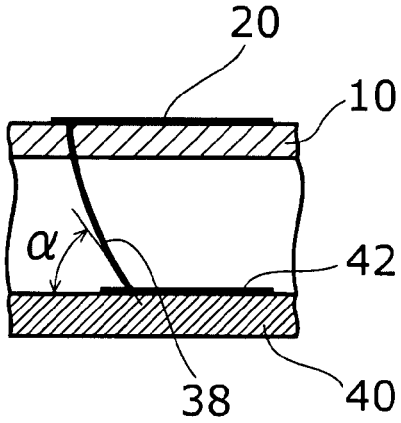
FIGS. 2A and 2B are schematic section views showing the vicinity of the conductive pin 38.
Figure 2B:
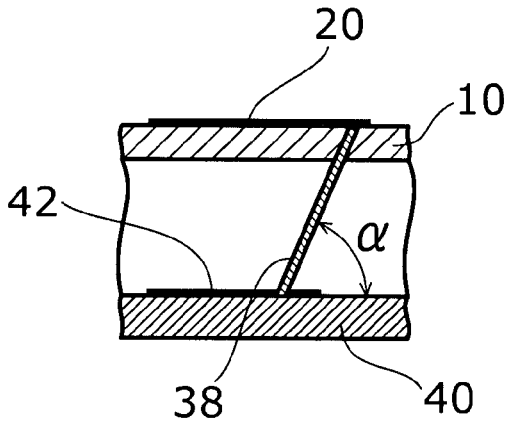

FIGS. 2A and 2B are schematic section views showing the vicinity of the conductive pin 38. One end thereof is connected to the antenna pattern 20 on the first molded body 10, and the fixed conductive pin 38 is inclined with respect to and in contact with the conductive pattern 42 on the substrate 40. That is, as shown in FIG. 2A, a contact angle $\alpha$ of the conductive pin 38 and the conductive pattern 42 is more than 0 and less than 90°. When the material of the conductive pin 38 is a metal, if the conductive pin 38 is set to a diagonal direction to a surface of the conductive pattern 42, a bending elasticity stress can be made to act thereon.

Moreover, as shown in FIG. 2B, even if bending due to bending elasticity stress is small, when the contact angle α is more than 0 and less than 90°, an electrically stable junction can be obtained.

Next, the structure of the connection part including the concave portion 14 of the first molded body 10 and the boss 32 of the second molded body 30 will be explained in more detail.

Figure 3A:
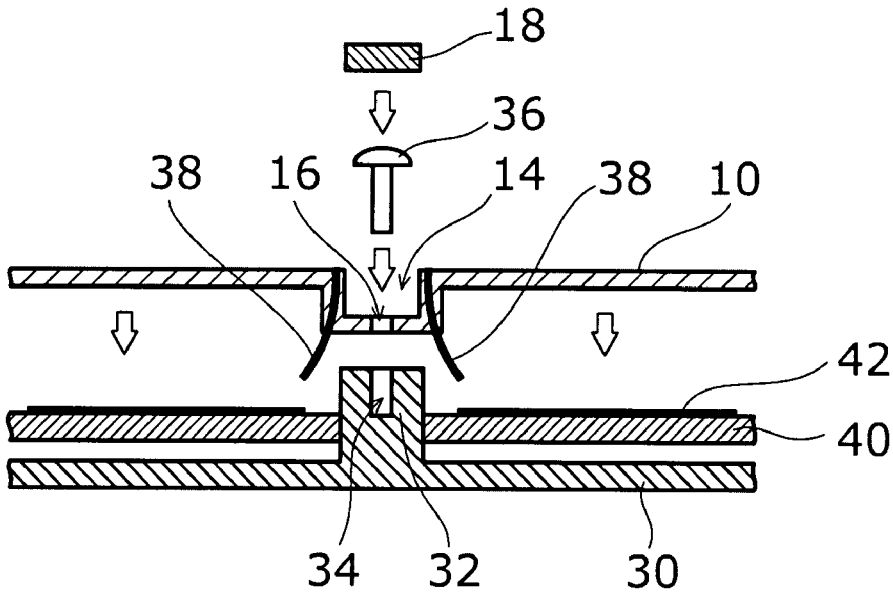
FIGS. 3A and 3B are schematic views for explaining the structure of the connecting part.
Figure 3B:
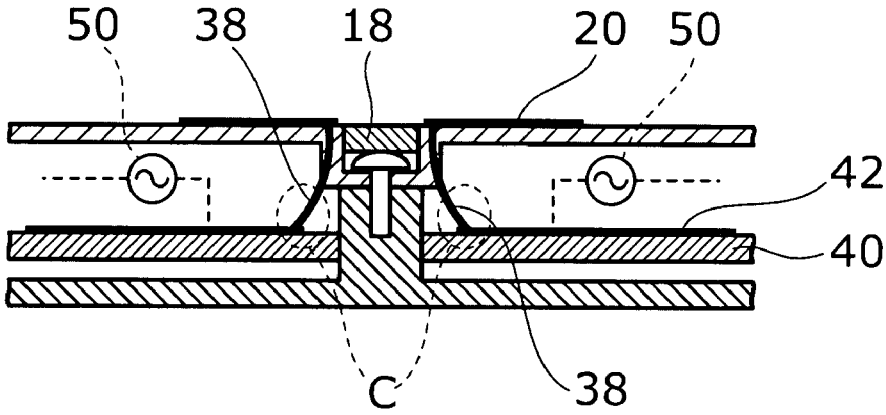

FIGS. 3A and 3B are schematic views for explaining the structure of the connecting part. As shown in FIG. 3A, the conductive pin 38 is preliminarily attached to the first molded body 10. A method for attaching the conductive pin 38 includes a method of forming a diagonal hole in a process of resin molding. Or, in the case of the first molding body 10 made of a heat-curable resin, the heated conductive pin 38 melts down some of the molded body 10. As a result, the conductive pin 38 is inserted and cooled and then fixed.

Furthermore, the formation can be performed by an in-mold method in which the conductive pin 38 is set in a mold. For preventing the inserted conductive pin 38 from dropping out, it is preferable that a projection such as burr is formed in the conductive pin 38.

In the case that a male screw 36 is inserted into a hole 16 in the bottom of the concave portion 14 of the first molded body 10 and fixed to the female screw 34 of the boss 32 with a screw, the conductive pin 38 is pressed and fixed onto the conductive pattern 42 of the substrate 40 so that the contact angle α is maintained to be more than 0 and less than 90°.

FIG. 3B shows a state of the fixation performed by screw cramp and is a schematic section view along the chain line AA in FIG. 1. In this embodiment, an occupied space for the contact in the conductive pattern 42 that is connected to a power supply part 50 in the substrate 40 is small, which is only in the vicinity of the conductive pin 38 as shown in dash lines C. By contrast, an occupied space for the contact in the case of a contact probe or a plate spring becomes large. Moreover, the structure by using the conductive pin 38 is simple and cost reduction becomes easy.

The first molded body 10 is fixed to the female screw 34 formed in the boss 32 with the male screw 36. A veneer 18 is fit into the concave portion 14 and the outer surface can be flat and the appearance can be favorable. The thickness of the antenna pattern 20 is some—some tens of micrometers, and if nothing is done, a step is left. When the step is reduced by thickening the coating on the surface except for the antenna pattern 20, the appearance can be favorable.

Figure 4A:
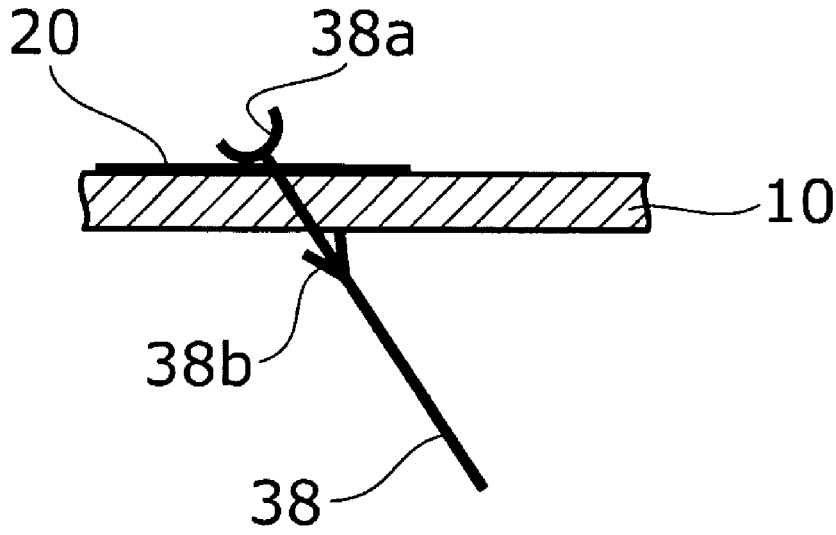
FIGS. 4A and 4B are schematic views for explaining a modified example of a head structure of the conductive pin 38.
Figure 4B:
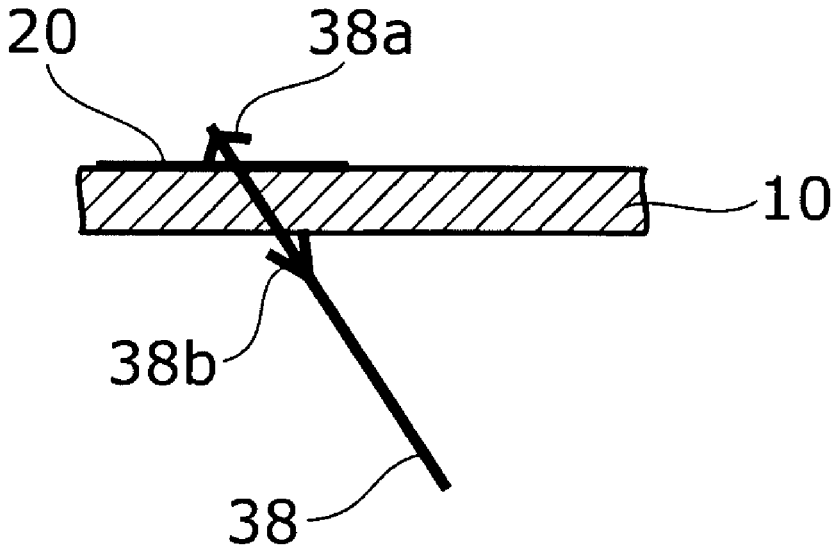

FIGS. 4A and 4B are schematic views for explaining a modified example of a head structure of the conductive pin 38. In FIG. 4A, the head 38*a* has a cup shape to be capable of being certainly in contact with the antenna pattern 20. A dropout-proof part 38*b* is formed at the midpoint for preventing dropout after the insertion. In FIG. 4B, the head 38*a* has an umbrella shape to enhance contact pressure to the antenna pattern 20 in the umbrella end part and thereby to be capable of being certainly in contact with the antenna pattern 20.

Figure 5A:
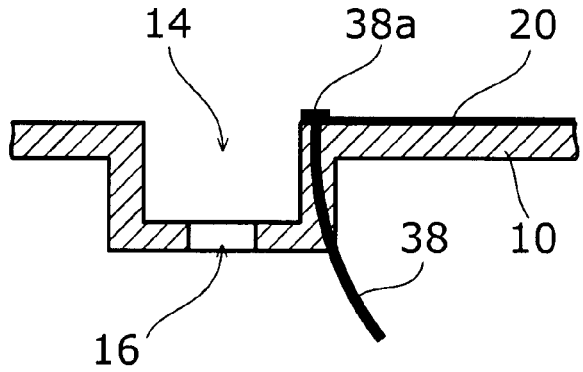
FIGS. 5A through 5D are schematic views showing a structure with respect to the conductive pin 38 having a circular arc shape.

FIGS. 5A through 5D are schematic views showing a structure with respect to the conductive pin 38 having a circular arc shape. In the case that the conductive pin 38 comes to have a circular arc shape as shown in FIG. 2A by bending elasticity, the conductive pin 38 occasionally comes to rotate and the contact point occasionally comes to be settled. Therefore, positioning of the rotational direction is required. In FIG. 5A, a hole is formed in a resin so as to be fit into a circular arc shape.

Figure 5B:
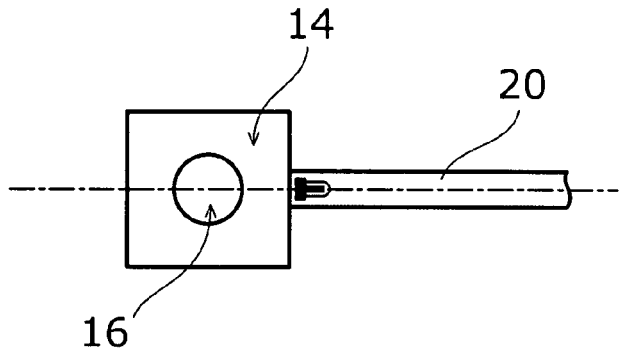
Figure 5C:
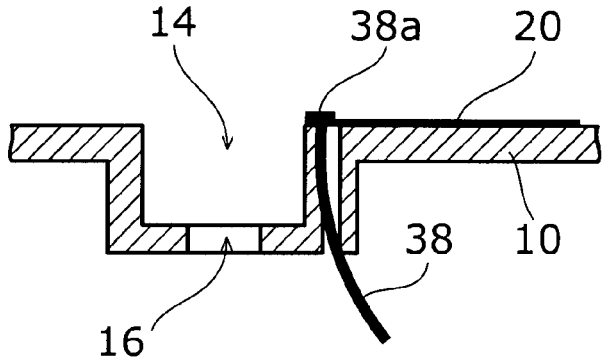
Figure 5D:
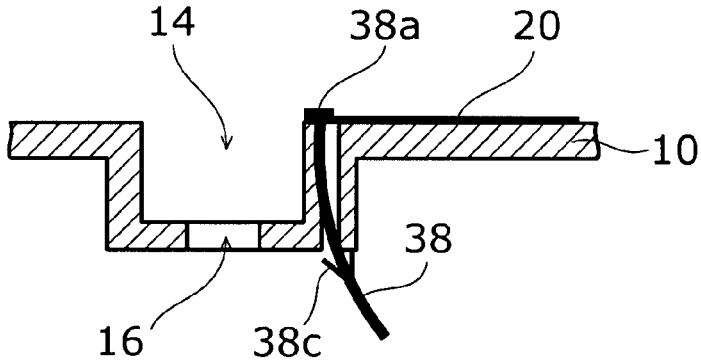

Moreover, the hole sectional shape is set to an ellipse, an circular-arc-shaped conductive pin 38 can be inserted thereinto. FIG. 5B is a schematic plan view before the conductive pin 38 is inserted, and FIG. 5C is a schematic section view thereof. Furthermore, as shown in FIG. 5D, a projection 38*c* is provided in the conductive pin 38, and thereby, the direction thereof can be fixed so as not to rotate in the hole.

The conductive pin 38 is not limited to the insertion from an outer surface of the housing.

Figure 6:
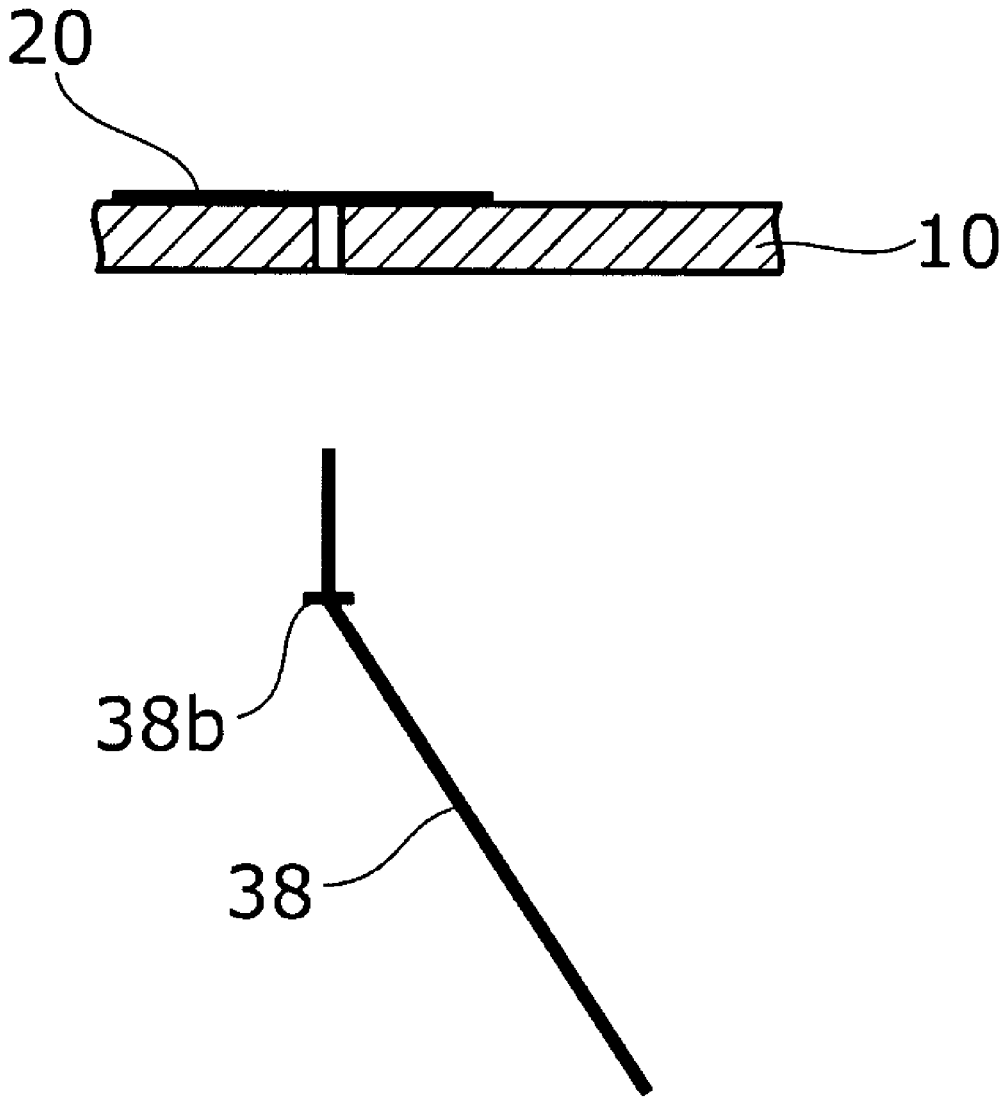
FIG. 6 is a schematic view showing a structure that the conductive pin 38 is inserted from an inner surface of the housing.

FIG. 6 is a schematic view showing a structure that the conductive pin 38 is inserted from an inner surface of the housing. In this case, it is preferable that the side contacting the conductive pattern 42 of the substrate 40 is bended so that the contact angle α is more than 0 and less than 90°.

Here, explanation on the antenna pattern will be complemented.

Figure 7A:
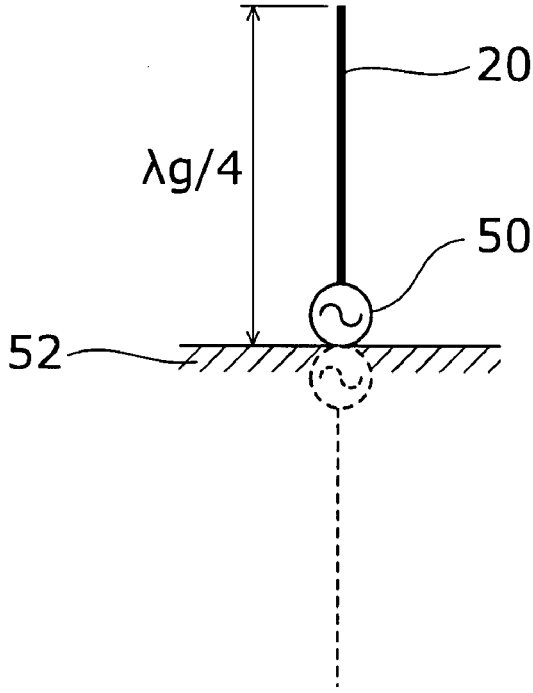
FIGS. 7A and 7B are schematic views showing a structure of an antenna.
Figure 7B:
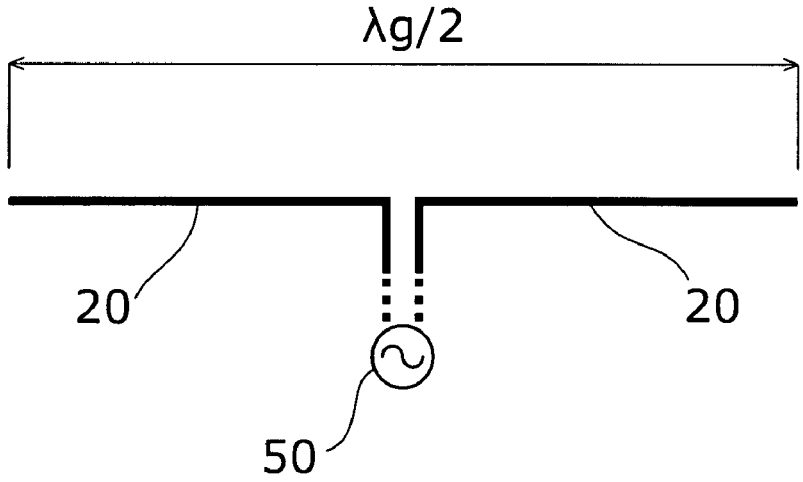

FIGS. 7A and 7B are schematic views showing a structure of an antenna. FIG. 7A is the case of a monopole antenna, and FIG. 7B is the case of a dipole antenna. The length of the antenna pattern 20 of a monopole antenna is an approximately quarter wavelength. The power supply part 50 is connected to one end of the monopole antenna and to a ground 52 and excites the antenna.

The ground 52 is, for example, provided on a back surface of the substrate 40 and acts as a half-wavelength antenna by an image represented by dash line in FIG. 7A. Because permittivity of a material composing the first molded body 10 is more than 1, the wavelength is shorter than that of free space and the antenna pattern 20 can be downsized.

FIG. 7B is a dipole antenna. The length of the antenna is an approximately half wavelength. Each of the two of the antenna divided at the midpoint of the antenna pattern 20 is connected to the power supply part 50 and the antenna is excited. The power supply part 50 is provided on the substrate 40 and connected to the antenna pattern 20 with the conductive pattern 42. As another antenna, an inverted-F antenna, a loop antenna, a folded monopole antenna, a folded dipole antenna, and so forth can be used.

In this embodiment, as shown in FIG. 1, it is easy to supply power to a plurality of the antenna patterns 20 from the one concave portion 14 of the first molded body 10 for screw cramp. In this case, it becomes easy to provide a plurality of antenna patterns 20 corresponding to a multiband system. That is, one of the antenna patters 20 can be used for a first frequency band, and other of the antenna patterns 20 can be used for a second frequency band which is different from the first frequency band.

As a result, the sending and receiving function can be extended including wireless LAN, FM and AM broadcast, GPS (Global Positioning System), and one-segment broadcast of receiving terrestrial digital broadcasting, as well as cellular-phone triple band such as GSM (Global System for Mobile Communication), and DCS (Digital Cellular System)/PCS (Personal Communications Service). Furthermore, an electronic apparatus being capable of downsizing and thinning with maintaining stable electrical connection is provided.

In the above-described embodiments, the case in which the conductive pattern is an antenna pattern has been explained, but this invention is not limited thereto. The conductive pattern for wiring with circuit components including a semiconductor element is also included in this invention.

In the above-described embodiment, a folding-type electronic apparatus including the upper housing 4 and the lower housing 6 has been explained. However, this present invention is not limited thereto. A sliding-type electronic apparatus is also possible. In this case, in the outer surface of the first molded body 10 of the upper housing 4, a display screen is disposed, and the outer surface of the second molded body 30 comes to face to the inner surface of the lower housing 6.

In such an open state of a sliding-type electronic apparatus, the antenna pattern 20 is occasionally provided on the outer surface of the second molded body 30 composing the upper housing 4. Moreover, without superposing the two housings, the case of one housing is possible.

As described above, the embodiments of this invention have been explained with reference to drawings. However, this invention is not limited to these embodiments. Various design changes by those skilled in the art with respect to the housing, the conductive member, the conductive pattern, the substrate, the power supply part, the antenna pattern, and so forth, which compose the electronic apparatus, are also included in this invention as long as not departing from the purport of this invention.

The invention claimed is:

1. An electronic apparatus comprising:

a first molded body made of an insulator, and having a concave portion in an outer surface;

a second molded body made of an insulator, closed together with the first molded body, and having a boss portion facing to the concave portion, the boss portion and the concave portion being fixed with a screw;

a first conductive pattern provided on the outer surface of the first molded body;

a second conductive pattern provided on a substrate, the substrate being fixed to the second molded body; and a first conductive pin provided so as to pass through the first molded body and connecting the first conductive pattern and the second conductive pattern, the first conductive pin passing through a side wall of the concave portion, the first conductive pin being curved in a circular arc shape between a junction with the first conductive pattern and a junction with the second conductive pattern toward the second conductive pattern and pressing the second conductive pattern by a bending elasticity stress, and positioning thereof being performed by a longitudinal hole provided along the side wall, a contact angle by the first conductive pin and the second conductive pattern being larger than 0° and less than 90°.

2. The electronic apparatus according to claim 1, wherein the longitudinal hole has an ellipsoidal sectional shape provided along the side wall.

3. The electronic apparatus according to claim 1, further comprising a veneer, the veneer being fit into the concave portion so that a step of the outer surface disappears.

4. The electronic apparatus according to claim 1, wherein an intermediate portion of the first conductive pin is provided with a dropout-proof projection.

5. The electronic apparatus according to claim 1, wherein the first conductive pin is provided with a head projection contacting the first conductive pattern.

6. The electronic apparatus according to claim 1, wherein the first conductive pattern is an antenna pattern.

7. The electronic apparatus according to claim 1, further comprising:

a third conductive pattern provided on the outer surface of the first molded body;

a fourth conductive pattern provided on the substrate; and a second conductive pin provided so as to pass through the first molded body and connecting the third conductive pattern and the fourth conductive pattern.

8. The electronic apparatus according to claim 7, wherein the first conductive pattern is a first antenna pattern for a first frequency band, and the third conductive pattern is a second antenna pattern for a second frequency band, the second frequency band being different from the first frequency band.

9. An electronic apparatus comprising:

a first molded body having a concave portion in an outer surface and being one part of a housing;

a second molded body having a boss portion facing to the concave portion and being the other part of the housing closed together with the one part of the housing, the boss portion and the concave portion being fixed with a screw;

a first conductive pattern provided on the outer surface of the first molded body;

a second conductive pattern provided in the housing; and a first conductive pin passing through the first molded body and connecting the first conductive pattern and the second conductive pattern, the first conductive pin passing through a side wall of the concave portion, the first conductive pin being curved in a circular arc shape between a junction with the first conductive pattern and a junction with the second conductive pattern toward the second conductive pattern and pressing the second conductive pattern by a bending elasticity stress, and positioning thereof being performed by a longitudinal hole provided along the side wall, a contact angle by the first conductive pin and the second conductive pattern being larger than 0° and less than 90°.

10. The electronic apparatus according to claim 9, wherein the longitudinal hole has an ellipsoidal sectional shape provided along the side wall.

11. The electronic apparatus according to claim 9, further comprising a veneer, the veneer being fit into the concave portion so that a step of the outer surface disappears.

12. The electronic apparatus according to claim 9, wherein an intermediate portion of the first conductive pin is provided with a dropout-proof projection.

13. The electronic apparatus according to claim 9, wherein the first conductive pin is provided with a head projection contacting the first conductive pattern.

14. The electronic apparatus according to claim 9, wherein the first conductive pattern is an antenna pattern.

15. The electronic apparatus according to claim 9, further comprising:

a third conductive pattern provided on the outer surface of the first molded body;

a fourth conductive pattern provided in the housing; and a second conductive pin passing through the first molded body and connecting the third conductive pattern and the fourth conductive pattern.

16. The electronic apparatus according to claim 15, wherein the first conductive pattern is a first antenna pattern for a first frequency band, and the third conductive pattern is a second antenna pattern for a second frequency band, the second frequency band being different from the first frequency band.

* * * * *